United States Patent [19]

Lech

[11] 3,962,870

[45] June 15, 1976

[54] VARIABLE VOLUME DUAL PUMP CIRCUIT

[75] Inventor: Richard J. Lech, Lockport, Ill.

[73] Assignee: International Harvester Company, Chicago, Ill.

[22] Filed: Apr. 23, 1975

[21] Appl. No.: 570,974

[52] U.S. Cl. ..... 60/428; 60/430; 60/456; 60/486

[51] Int. Cl.[2] ..... F15B 13/09

[58] Field of Search ..... 60/420, 422, 428, 430, 60/456, 486

[56] References Cited

UNITED STATES PATENTS

| | | | |
|---|---|---|---|
| 2,309,983 | 2/1943 | Riddle | 60/430 X |
| 3,659,419 | 5/1972 | Ikeda | 60/456 X |
| 3,785,157 | 1/1974 | Kittle et al. | 60/456 X |
| 3,859,790 | 1/1975 | Bacquie | 60/486 X |

*Primary Examiner*—Edgar W. Geoghegan
*Attorney, Agent, or Firm*—Douglas W. Rudy; Floyd B. Harman

[57] ABSTRACT

A hydraulic pump arrangement and control circuit for supplying fluid at high volume and high pressure to a work circuit. The system utilizes a fixed displacement pump, a variable displacement pump with a compensator, and a relief valve at a pressure setting higher than the variable displacement pump's compensator setting.

7 Claims, 3 Drawing Figures

VARIABLE VOLUME DUAL PUMP CIRCUIT

BACKGROUND OF THE INVENTION

1. Field of the Invention

The invention relates to hydraulic fluid control and distribution systems for use on construction loaders, agricultural or industrial tractors, or other mobile implement carrying equipment having a fixed displacement pump working in conjunction with a variable displacement pump having a compensator actuated swash plate. Fluid delivery rates are dictated by the interaction of the pumps and a relief valve.

2. Description of the Prior Art

It is well known to mount two fixed displacement pumps in tandem in a hydraulic circuit and control the output of these pumps through the use of various valving arrangements. However, the use of a fixed displacement pump becomes uneconomical in an application that requires high pressure but negligible flow for any period of time as the fixed displacement pump will continue to attempt to deliver full fluid flow even when only minimal fluid flow is needed by the subject hydraulic system. The inefficiency of having one or more than one fixed displacement pumps running at continuous maximum output when only a minute amount of fluid flow is needed is obvious. Another difficulty encountered is that the pump drive means will be overtaxed unnecessarily as it will be driving the pump or pumps, which will be at high pressure, at a horsepower rate proportionately distorted from the work being performed by the hydraulic system.

A viable alternative to using a fixed displacement pump in a hydraulic system is to use a variable displacement pump of which the stroke can be adjusted to fill the need of either high volume or high pressure as required. Unfortunately, a variable displacement pump is normally an expensive unit when compared to a fixed displacement pump.

Another disadvantage of variable displacement pumps is that they cannot generate the instantaneous pressure sometimes desirable when using construction type earth moving equipment. Operators of construction equipment desire an immediate acting hydraulic system in order to assist in excavating situations where it is felt that penetration of the ground is enhanced by the shock generated when an implement is driven into the ground.

Another apparent disability of the variable displacement pump hydraulic system in an excavating application is that when the operator is operating his digging implement in an area screened from his vision he has difficulty knowing when the implement has penetrated the ground as far as possible. This is because the variable displacement pump will have destroked in order to provide maximum hydraulic pressure and the drive means, usually the vehicle engine, will be providing only nominal horsepower to drive the fully destroked variable displacement pump. For practical purposes the vehicle engine will be close to its idle speed as only minimum horsepower will be needed, yet pressure inside the cylinders operating the digging implements will be very high. At this point the operator will have to guess whether or not the implement has ceased its digging function. In an hydraulic system incorporating a fixed displacement pump the operator will know when the digging implement has reached its maximum potential as the vehicle engine will bog down in response to the high horsepower needed to drive the fixed displacement pump at high pressure.

It is known to provide fixed displacement pumps in series with variable displacement pumps to act as charging pumps for the variable displacement pumps. A fixed displacement pump in this configuration is usually of similar displacement as the variable displacement pump. The drawback of a system having a variable displacement pump charged by a large fixed displacement pump primarily centers around the inefficiency and high cost of providing two pumps of which only one pump is harnessed for useful work.

Therefore, the combination of a fixed displacement and a variable displacement pump in a regulated system such as disclosed in this invention will have the advantage of the instant acting fluid delivery inherent in the fixed displacement pump and the high pressure, low horsepower consuming characteristics available with the variable displacement pump. A combination pump system maximizes performance, efficiency and dependability while minimizing cost.

A specific object in the invention is to provide a hydraulic fluid pump system that is capable of instantaneous fluid flow to the working cylinders.

Another object of the invention is to provide high pressure to working cylinders without wasting horsepower by the unnecessary pumping of fluid. Still another object of this invention is to provide the capability of instant fluid flow and high pressure generation with the unnecessary wasting of horsepower.

Another object of the invention is to provide a combined fixed and variable displacement pump system in which the fixed displacement pump provides fluid flow to the work circuit.

SUMMARY OF THE INVENTION

In a variable volume fluid delivery circuit for a vehicle such as a backhoe and bucket equipped industrial tractor or a loader vehicle, an assembly of components including a fixed displacement pump, a variable displacement pump having a pressure actuated compensator, and a relief valve all communicatively combined to enable efficient horsepower utilization from the vehicle engine. As pressure increases in the fluid delivery circuit the variable displacement pump is destroked progressively through the actuation of the actuator resulting from fluid pressure and after the variable displacement pump is fully destroked the fixed displacement pump will continue to increase the circuit pressure until the relief valve is actuated allowing fluid to bypass the system's work circuit.

The vehicle engine will bog down as pressure increases prior to the relief valve dumping thus informing the vehicle operator that the excavating capacity of the implement being used is being approached. When the relief valve dumps the engine will be under maximum load.

BRIEF DESCRIPTION OF THE DRAWINGS

Other objects and advantages of the invention will become apparent upon reading the following detailed description and upon reference to the drawings wherein.

The present invention may of course be utilized in various types of vehicles, as for instance, earthworking machines, agricultural vehicles, material handling machines and similar like vehicles.

DETAILED DESCRIPTION OF THE INVENTION

Figure 1:
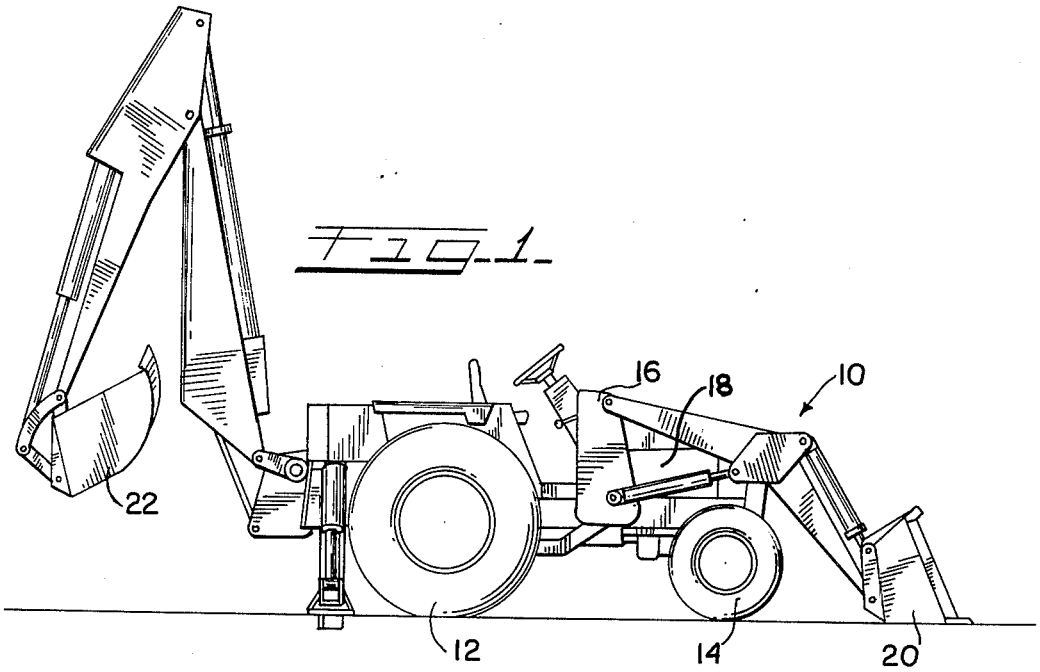
FIG. 1 is a pictorial presentation of a vehicle wherein the proposed invention has been incorporated.
Figure 2:
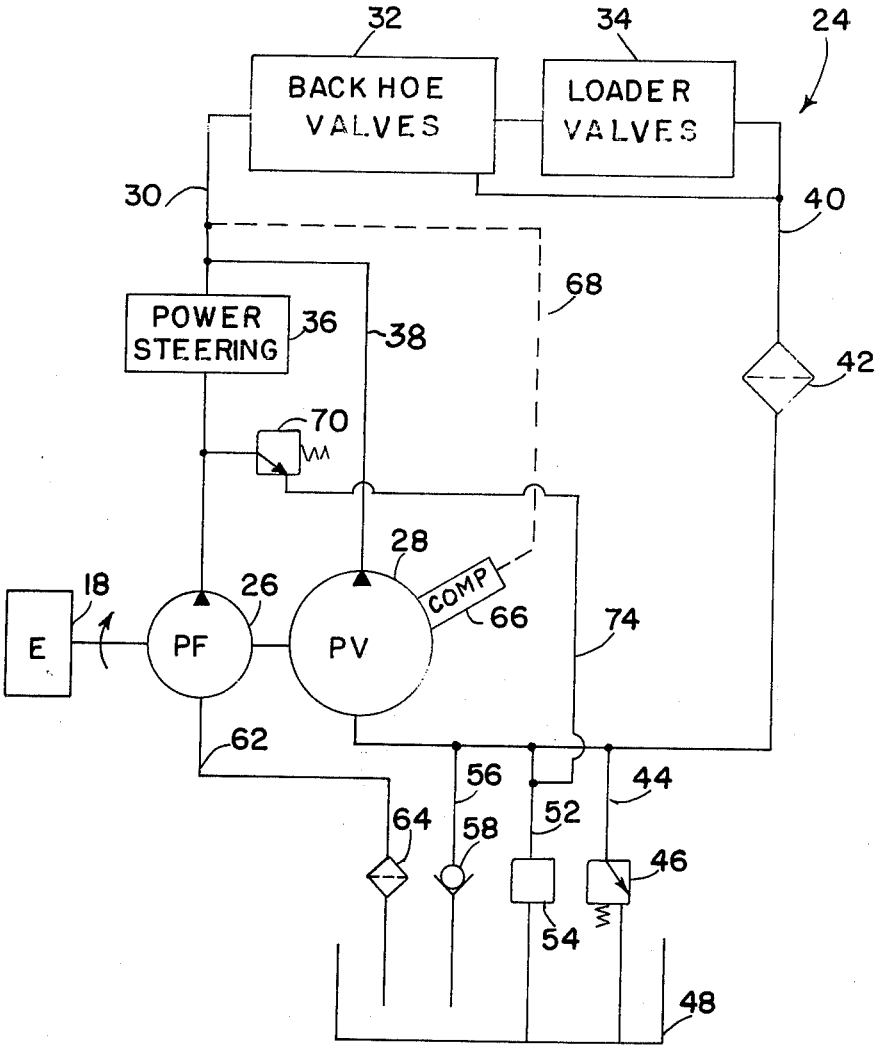
FIG. 2 presents a schematic diagram of a combined pump system of the invention.

Referring now to FIG. 1 an industrial tractor is depicted for purposes of illustration. The invention as depicted applies to a hydraulically powered and controlled selfpropelled vehicle as shown, which has earthworking devices installed at either ends thereof. An industrial tractor, indicated in its entirety by the reference numeral 10, may include pairs of traction wheels 12 (only one shown) and steerable wheels 14 (only one shown) suitably mounted on opposite ends of a chassis structure 16 and a prime mover such as the engine 18. A front end loader device such as a unit indicated at 20 may be suitably mounted on the forward facing end of the tractor, while a backhoe device such as indicated by 22 may be mounted on the rearwardly facing end of the vehicle. As this type of vehicle is conventional and is not specifically pertinent to the inventive concepts of this invention it is felt that no further description or explanation of the details of construction and operation thereof are necessary. It will be understood that suitable control in operating mechanisms will be provided to effect operation of the vehicle including the appended working implements. It should also be noted that the vehicle is provided with suitable driving mechanisms including an engine means, a transmission means, and a differential and axle means for transmitting power to the traction wheels. Referring now to FIG. 2 which is a diagramatic view of a hydraulic system incorporating the invention of a schematic circuit represented generally by 24 shows an engine means 18 located to drive a fixed displacement pump 26 generally but not exclusively of the gear type and to also drive a variable displacement pump 28. Both pumps are used to provide fluid to the schematic circuit generally depicted as 24 through various conduit means described herein.

Conduit means 30 provides for fluid communication between the outlet of the fixed displacement pump 26 and a work circuit as shown for example as backhoe valves 32, loader valves 34 and power steering system 36 and also accepts fluid input from conduit 38 which leads from the outlet port of the variable displacement pump 28. Thus flow from both pumps can progress simultaneously to the work circuit. The vehicle could have a work circuit consisting of any one of many hydraulically operated components, however, in the above recited specific equipment it is not intended to limit the work circuit makeup used to illustrate the invention.

Spent fluid may pass from the work circuit through conduit 40 to the inlet of the variable displacement pump 28 after flowing through a filter 42. Also several alternative paths of fluid flow are available as shown by conduit 44 which leads through a by-pass valve 46 before progressing to a reservoir 48. The by-pass valve 46 can be either a pressure actuated unloading valve as shown or an equivalent valve.

Another fluid passage is offered by conduit 52 which passes through an oil cooler 54 on route to the reservoir 48. Conduit 56 will only allow fluid passage from the reservoir 48 to conduit 40 due to the imposition of check valve 58 in conduit 56. The fluid in conduit 40 is maintained at a pressure somewhat above atmospheric in order to provide charging pressure for the pump 28. This is done by restricting flow through the oil cooler 54 such that the pressure on the inlet side of the oil cooler and consequently in conduit 40, is greater than the fluid pressure on the outlet side of the oil cooler. Hydraulic fluid which has passed through the oil cooler 54 may then be drawn to the fixed displacement pump 26 through the filter 64 as necessary.

Fluid passing from the work circuit may also be used to charge the variable displacement pump 28. The variable displacement pump does not have a separate low displacement charging pump but may receive fluid from the fixed displacement pump after this fluid has passed through the work circuit. Upon initiation of work by the work circuit the fluid being directed to the work circuit from the fixed displacement pump will in part go directly to the variable displacement pump in order to assist the charging function. Therefore the fixed displacement pump in the instant invention is unlike other combination pump systems where the fixed displacement pump is solely a charging pump in that it is primarily a work circuit supply pump that also may be used to charge the variable displacement pump.

When a restriction exceeding the designed expectation of the oil cooler 54 occurs, such as when the fluid is cold, the by-pass valve 46 will be actuated to allow passage from conduit 40 to the reservoir 48.

The fixed displacement pump 26 receives fluid from the reservoir 48 by means of conduit 62 which is equipped with a filter 64.

Sensing of system pressure is accomplished by the compensator or actuator 66 integral with the variable displacement pump 28. This compensator is the usual type generally associated with the hydraulic actuation of the swash plate mechanism of a variable displacement piston pump as is used in this embodiment. The compensator receives a pressure signal from the pilot line 68 which communicates between the piston (not shown) of the compensator and fluid delivery circuit 30.

System pressure is also sensed by the relief valve 70 which is set to allow the dumping of fluid through conduit 74 to the conduit 52 of heat exchanger 54 at a pressure higher than that pressure needed to fully destroke the variable displacement pump 28. Operation of the variable volume circuit as shown in FIG. 2 is as follows.

When the work circuit, comprising various hydraulic cylinders or other hydraulic motors, is signalled by the vehicle operator to perform the work function such as trenching with a backhoe the fluid in conduit 30 will become pressurized as the appropriate bucket and boom cylinders experience greater and greater pressure as a result of the implement being forced into the ground.

The operator, striving to get the highest utilization of the excavating scoop will continue to force the scoop into the ground until it has been loaded to its maximum. As the implement digs deeper into the ground higher cylinder pressures are provided by the variable volume dual pump circuit in the following sequence.

Fluid is supplied to the work circuit, in this case the backhoe valves 32, by the combination of the fixed displacement pump 26 and the variable displacement pump 28 through conduit 30. A larger percentage of the fluid is supplied by the variable displacement pump which is, in this embodiment, approximately three times larger than the fixed displacement pump. As pressure builds in the supply conduit the pressure build up is communicated to the compensator or actuator 66 of the variable displacement pump 28. This compensator will initiate the adjustment to the pump 28 swash plate the angle of adjustment resulting in destroking of the pump 28 upon attainment of a predetermined pressure. Compensation will continue as circuit pressure builds up until the variable displacement pump is fully destroked. This variable displacement pump will destroke very rapidly with complete destroking thereof occurring at a pressure approximately 100 p.s.i. higher than the initial pressure activating the compensator.

As the variable displacement pump is being destroked the engine 18 is being called on for the output of less and less horsepower. The horsepower or engine load requirement will decrease when the variable displacement pump is destroked due to the decrease in the amount of fluid being pumped to the work circuit.

As the pressure in the work circuit increases further, the variable displacement pump will become destroked and the pressure being generated by the fixed displacement pump will continue to increase at a very slow rate. Almost all of this pressure increase is attributable to the fixed displacement pump as the fully destroked variable displacement pump is maintaining pressure in the circuit but is not significantly building pressure.

The greatest power draw and load on the engine by the hydraulic pumps occurs just before the variable displacement pump destrokes. After this pump destrokes the power draw or load will increase gradually as shown on the graph as the power needed to drive the fixed displacement pump becomes greater. This will cause the prime mover to become bogged down. Engine rpm will drop as the horsepower needed to drive the fixed displacement pump will be greater than the maximum output potential of the engine.

However, the relief valve 70 is preset to open before the engine stalls. This relief valve opening will allow the fluid to flow from the conduit 30, which is fed by pumps 26 and 28, to the inlet side of the heat exchanger 54. By allowing fluid to flow through this relief valve the fixed displacement gear pump is not "fluid bound" thereby allowing the prime mover to recover from the bogged down state and return to a condition where it is operating under maximum load.

Pressure to the work circuit can only get as high as the presetting pressure of the relief valve 70.

As mentioned earlier the bogging down of the engine is an aid to the operator as it allows him to know when the working implement, in the discussed embodiment, the trenching scoop, has ceased its propagation through the earth. This bogging down signal will inform the operator to lift the scoop from the trench and to start another cycle.

The operation of the equipment implements are further enhanced through the use of the fixed displacement pump in situations that require high fluid flow but only secondarily require fluid pressure. Such situations occur, for instance, in the transfer or swing of the backhoe boom from its digging plane to its dumping zone. Another example where the "instant" flow potential of the fixed displacement gear pump is helpful is when the vehicle operator wishes to drive the digging implement into the ground. The high flow being delivered by the fixed displacement pump fills the appropriate cylinders rapidly and allows rapid acceleration of the implement.

It is significant to note that the relief valve 70 when actuated, passes fluid through conduit 74 to the inlet side of the oil cooler 54. As heat is generated in the fluid as it passes through the relief valve it is advantageous to cool this fluid before allowing it to recirculate into the hydraulic work circuit.

It should also be noted that the fixed displacement pump in addition to its function as a pump supplying the work circuit, also provides charging pressure for the variable displacement pump 28.

Figure 3:
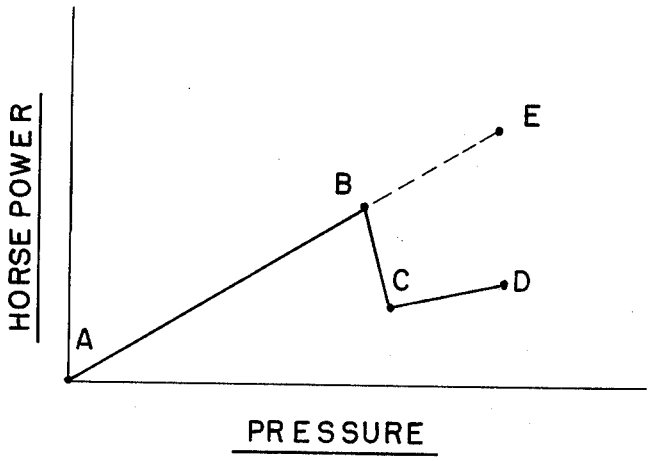
FIG. 3 shows a graph related to the invention.

The graph shown as FIG. 3 may be helpful in understanding the advantage of this combined pump system. As can be seen, the horizontal axis denotes pressure generated in the system while the vertical axis indicates the horsepower used in the system. Quantitative increments are not assigned to either axis as the graph has been presented to show relationship between pressure and horsepower using the variable volume dual pump circuit.

From point A to point B both pumps are working together to deliver fluid resulting in a increase in pressure. Horsepower is needed in a direct relationship to the pressure being generated.

At point B the variable displacement pump begins to destroke. From point B to point C the pressure builds slightly while the horsepower required to drive the pumps decreases.

At point C the variable displacement pump is fully destroked.

From point C to point D pressure is increased significantly while horsepower is increased slightly.

At point D the relief valve 70 unloads the fluid being pumped by the fixed displacement pump.

Dotted line B-E represents the horsepower that would be necessary if the variable displacement pump was not incorporated into the system. In other words a bigger engine (assuming pump displacements and other criteria being equal) would be necessary to get the pressure developed by the pumps driven by this small engine. The vertical distance between point B and point E represents the increase in engine size, as a function of horsepower available necessary to get equal pressure generation from a pump system having a fixed displacement gear pump only.

Thus it has been shown that the variable volume dual pump circuit disclosed herein fulfills the intended objects, aims and advantages as set forth above. While the invention has been described in conjunction with specific embodiments thereof it is evident that many alternative modifications and variations will be apparent to those skilled in the art in light of the foregoing description. The use of this dual pump system may be desirable on other types of equipment both agricultural and industrial, thus the scope of this invention is intended to encompass these alternatives also. Also even though the invention has been shown in a circuit including several ancillary components such as a heat exchanger or radiator and a by-pass valve it is not intended that these components limit the scope or application of the invention.

What is claimed is:

1. In a hydraulic fluid control circuit for use on a vehicle having an engine means capable of providing driving means, a work circuit composed of a plurality of cylinders, a reservoir and a conduit means for distributing fluid flow, the improvement comprising:

a fixed displacement pump being driven by said driving means for providing fluid to said work circuit by means of said conduit means;

a variable displacement pump being driven by said driving means and providing fluid to said work circuit by means of said conduit means;

an actuating compensator for effecting the displacement output of said variable displacement pump communicating with the output of said variable displacement pump and said conduit means and responsive to fluid pressure in said conduit means whereby higher pressure in said conduit means actuates said actuating compensator to decrease the stroke of said variable displacement pump and whereby low pressure in said conduit means actuates said actuating compensator to increase the stroke of said variable displacement pump;

a relief valve responsive to relieve pressure in said conduit means at a pressure higher than the pressure needed to fully destroke said variable displacement pump whereby actuation of said relief valve will allow fluid being pumped by said fixed displacement pump to be passed to the reservoir.

2. In a hydraulic fluid circuit for use on a vehicle having drive means capable of driving accessory equipment, a fluid circuit, a fixed displacement pump, a variable displacement pump both driven by said drive means, a relief valve and a work circuit all communicatively associated by conduit means allowing fluid passage wherein said work circuit further comprises:

a reservoir for containing fluid for use in said work circuit;

a first filter for filtering fluid from said reservoir as it passes through said conduit to said fixed displacement pump;

a second filter for filtering fluid from said reservoir as it passes from said work circuit to said reservoir by means of said conduit;

a by-pass valve allowing passage of fluid from said work circuit to said reservoir only when the pressure in said work circuit is high enough to open said by-pass valve;

an oil cooler interposed between the work circuit and the reservoir providing limited passage of oil therethrough;

a check valve allowing passage from said reservoir to said variable displacement pump but not allowing flow from said variable displacement pump to said reservoir.

3. The invention in accordance with claim 2 wherein said by-pass valve, said oil cooler, and said check valve provide for charging pressure in the work circuit for charging the variable displacement pump as the flow of fluid from the work circuit cannot pass unimpeded to the reservoir but can pass unimpeded to the inlet of the variable displacement pump providing charging thereof.

4. In a variable volume fluid delivery circuit for a vehicle having a pump driving means, a work circuit with a reservoir, a fixed displacement pump, a variable displacement pump, with a pressure actuated compensator, and a relief valve communicatively connected on its input side to said work circuit and on its output side to said reservoir by conduit means, the improvement comprising the relationship between the fixed displacement pump, variable displacement pump, the relief valve and the work circuit whereby as pressure increases in said circuit said variable displacement pump is destroked progressively due to the actuation of said compensator resulting from fluid pressure and after the variable displacement pump is fully destroked both the fixed displacement pump and the variable displacement pump will continue to pump and increase the circuit pressure until said relief valve is actuated allowing fluid to pass from both pumps to said reservoir as long as pressure in said circuit remains higher than the pressure setting of said relief valve.

5. In a hydraulic circuit including a hydraulic pump and a hydraulic motor means for supplying hydraulic fluid at an initial high volume and subsequently high pressure comprising:

a fixed displacement pump capable of delivering a high volume of hydraulic fluid to the hydraulic motor;

a variable displacement pump capable of delivering an initial high volume of fluid to the hydraulic motor, the variable displacement pump having a compensator capable of destroking the variable displacement pump responsive to pressure increases in the hydraulic motor for delivering fluid under high pressure to the hydraulic motor;

a pressure relief valve normally allowing undiminished flow of fluid from the fixed displacement pump and the variable displacement pump to the hydraulic motor providing an auxiliary path of hydraulic fluid flow from the pumps when pressure in the hydraulic motor exceeds the relief setting of the pressure relief valve;

a reservoir containing hydraulic fluid for pumping by the fixed displacement and variable displacement pumps and for receiving hydraulic fluid from the hydraulic motor;

conduit means connecting the fixed displacement pump and the variable displacement pump to the hydraulic motor, further providing a passage for hydraulic fluid from the hydraulic motor to the reservoir.

6. In a vehicle having a hydraulic motor supplied with fluid volume and pressure by a plurality of pumps being driven by an engine, a reservoir containing hydraulic fluid for pumping by the pumps and for receiving fluid from the hydraulic motor, conduit means providing fluid passages from the reservoir to the pumps, from the pumps to the motor and to the reservoir from the motor, means decreasing the load drawn by the pumps from an engine when the load being drawn approaches the maximum load capability of the engine comprising:

a variable displacement pump normally operated in a full stroke mode being destroked when the fluid pressure in the hydraulic motor approaches the point where the load on the engine necessary to drive the pumps approaches the maximum load capability of the engine;

a fixed displacement pump being driven by the engine;

a pressure relief valve normally allowing a path of fluid flow from the fixed displacement pump to the hydraulic motor providing a path of fluid flow from the fixed displacement pump to the reservoir when the engine load necessary to drive the fixed displacement pump and the destroked variable displacement pump approaches the maximum load capability of the engine.

7. In a vehicle having a hydraulic motor supplied with fluid volume and pressure by a fixed displacement pump and a variable displacement pump having a pressure responsive compensator capable of destroking the variable displacement pump that requires less power to drive when it is in a destroked condition, both the fixed and the variable displacement pumps being driven by an engine, a reservoir containing hydraulic fluid for pumping by the fixed and variable displacement pumps and for receiving hydraulic fluid from the hydraulic motor, conduit means connecting the fixed displacement pump and the variable displacement pump to the hydraulic motor and from the hydraulic motor to the reservoir, a pressure relief valve between the fixed displacement pump and the hydraulic motor capable of allowing fluid flow from the fixed displacement pump to the reservoir, a means for rapidly maximizing the volume and pressure of fluid delivered to the hydraulic motor comprising the steps of:

driving the fixed displacement pump and the fully stroked variable displacement pump by means of the engine to supply a volume of hydraulic fluid to the hydralic motor;

destroking the variable displacement pump at the point in time when the power being expended to drive the fixed displacement pump and the variable displacement pump approaches the maximum power capability of the engine;

driving the fixed displacement pump and the destroked variable displacement pump by means of the engine to supply pressurized hydraulic fluid to the hydraulic motor;

providing a restricted alternative path for hydraulic fluid between the fixed displacement pump and the hydraulic motor at the point in time when the power being expended to drive the fixed displacement pump and the destroked variable displacement pump approaches the maximum power of the engine by means of the pressure relief valve;

continuing the driving of the fixed and destroked variable displacement pump to maintain fluid volume and pressure in the hydraulic motor.

* * * * *